United States Patent [19]

Takahashi et al.

[11] Patent Number: 4,920,551

[45] Date of Patent: Apr. 24, 1990

[54] ROTATING ANODE X-RAY TUBE

[75] Inventors: Hiroshi Takahashi; Kenichi Takahara, both of Tokyo, Japan

[73] Assignee: Kabushiki Kaisha Toshiba, Kanagawa, Japan

[21] Appl. No.: 349,927

[22] Filed: May 9, 1989

Related U.S. Application Data

[63] Continuation of Ser. No. 912,911, Sep. 29, 1986, abandoned.

[30] Foreign Application Priority Data

Sep. 30, 1985 [JP] Japan ..... 60-216581

[51] Int. Cl.[5] ..... H01J 35/26

[52] U.S. Cl. ..... 378/125; 378/144

[58] Field of Search ..... 378/125, 127, 143–144

[56] References Cited

U.S. PATENT DOCUMENTS

| | | | |
|---|---|---|---|
| 1,893,759 | 1/1933 | Bouwers | 378/125 |
| 1,902,502 | 3/1933 | Hofmann | 378/125 |
| 2,250,322 | 7/1941 | Atlee | 378/144 |
| 3,710,162 | 1/1973 | Bougle | 378/144 |
| 3,878,395 | 4/1975 | Siefert et al. | 378/132 |
| 3,942,015 | 3/1976 | Huxley | 378/144 |
| 4,052,640 | 10/1977 | Hueschen et al. | 378/144 |
| 4,071,768 | 1/1978 | Goodenough | 378/125 |
| 4,679,220 | 7/1987 | Ono | 378/125 |

FOREIGN PATENT DOCUMENTS

| | | | |
|---|---|---|---|
| 0594434 | 4/1934 | Fed. Rep. of Germany | 378/144 |
| 2555359 | 5/1985 | France | 378/144 |
| 0135555 | 8/1983 | Japan | 378/125 |
| 60-19619 | 5/1985 | Japan . | |
| 60-95841 | 5/1985 | Japan . | |

*Primary Examiner*—Craig E. Church
*Assistant Examiner*—John C. Freeman
*Attorney, Agent, or Firm*—Finnegan, Henderson, Farabow, Garrett and Dunner

[57] ABSTRACT

A rotating anode X-ray tube is provided which includes an anode disk having a central axis of rotation and a circumferential peripheral edge lying in a plane perpendicular to that axis of rotation. A ring-shaped target is mounted to the disk adjacent the peripheral edge and the disk includes a mechanism formed integrally solid with the disk and remote from the target for mounting the disk to a support shaft of a rotor within a vacuum housing to permit rotation of the disk about the axis of rotation of the disk. The disk is formed integrally solid along the aforementioned plane, including that portion of the disk coincident with the axis of rotation and the disk has a thickness which increases progressively in a radially inward direction from the peripheral edge, including that portion of the disk between the target and the mechanism for coupling, to counteract a radially inward increase in the disk upon high speed rotation of the disk. A cathode is provided for bombarding the target with thermions to generate X-rays which escape the vacuum housing through an appropriately placed X-ray penetrable window.

5 Claims, 2 Drawing Sheets

ROTATING ANODE X-RAY TUBE

This application is a continuation of application Ser. No. 912,911 filed Sept. 29, 1986, abandoned.

BACKGROUND OF THE INVENTION

I. Field of the Invention

The present invention relates to a rotating anode X-ray tube in which the anode may be rotated at a high rate of speed.

II. Background Information

Rotating anode X-ray tubes are known which comprise a vacuum housing and a rotating anode mounted within that housing. The rotating anode contains a target surface against which thermions emitted from a cathode are bombarded, with the energy of the thermions discharged as X-rays. The rotating anode is mounted within the vacuum housing to a rotor of a motor, with the rotor of the motor supported in the vacuum housing with a suitable bearing mechanism.

Anodes of such prior art rotating anode X-ray tubes are generally shaped in the form of an umbrella as illustrated in FIG. 1 by anode 10. Anode 10 of FIG. 1 may comprise molybdenum, either in essentially pure form or as an alloy. A ring-shaped target 12 made of tungsten, either in essentially pure form or as an alloy, is fittedly mounted in a surface of anode 10 adjacent the circumferential peripheral edge 14 of anode 10. Anode 10 is coupled to a support shaft 14 of a rotor of a motor (not shown) by having the distal end 16 of shaft 14 extend through a bore or opening 18 in anode 10 along the axis of rotation 20 of anode 10. Anode 10 is held in a fixed relation to shaft 14 by operation of nut 22 attached to that portion of distal end 16 of shaft 14 which extends beyond opening 18 of anode 10.

When employing an anode such as prior art anode 10 illustrated in FIG. 1, in order to get a clear and quality picture thermions need to be focused to strike target 12 in as small an area as possible and with as great a power input as possible. In order to achieve a large power input on a small focus area of target 12, the diameter of target 12 needs to be made as large as possible and/or anode 10 needs to be rotated as fast as possible. However, anode 10 is disposed inside a vacuum housing and, thus, the diameter of target 12 is limited by the internal dimensions of that vacuum housing. Accordingly, in order to obtain a clear and quality resultant X-ray picture, anode 10 needs to be rotated as fast as possible.

The prior art anode 10 of FIG. 1, however, has a limitation on the rate of rotation possible based upon the maximum centrifugal stress at the inside of anode 10 and the inherent manufacturing tolerances between the internal dimensions of bore 18 of anode 10 and the external dimensions of distal end 16 of shaft 14 which extends through that bore. The inherent manufacturing tolerances required to permit insertion of shaft 14 through bore 18 of anode 10 results in a certain amount of play between shaft 14 and anode 10 which, in turn, results in a backlash of anode 10 upon high speed rotation of anode 10, resulting in an imbalance of anode 10 and, therefore, a limitation on the ultimate rate of rotation which may be obtained by anode 10. Imbalance also results from any off-centering of bore 18 from the center of anode 10 and from any lack of symmetry in the roundness of bore 18.

Thus, the limitations on manufacturing tolerances existent in the positioning, roundness and size of bore 18 limits the ultimate rate of rotation which may obtained by anode 10 due to large centrifugal forces that affect the central portion of anode 10 along axis of rotation 20. Due to this limit on the rate of rotation which may achieved by anode 10, target 12 is subjected to more heat per unit area than would be the case at a higher rate of rotation and, thus, target 12 must be made thicker than would be the case if a higher rate of rotation of anode 10 were possible. Accordingly, the difference between the coefficient of expansion of the metal from which target 12 is constructed and the coefficient of expansion of the metal from which anode 10 is constructed, coupled with the necessarily thick dimensions of target 12, subjects target 12 to the likelihood of becoming separated from the surface of anode 10.

SUMMARY OF THE INVENTION

In view of the foregoing, an object of the present invention is to provide a rotating anode X-ray tube capable of rotating the anode of that tube at a high rate of speed, thereby permitting a high power input with a small focus necessary to obtain a clear and quality resultant X-ray picture Additional objects and advantages of the invention will be set forth in the description which follows and, in part, may be obvious from that description or may be learned by practice of the invention.

To achieve the foregoing objects, and in accordance with the purposes of the invention as embodied and broadly described herein, a rotating anode X-ray tube is provided which comprises: a vacuum housing; an anode support shaft located at least in part inside that housing; means for rotating the support shaft; a ring shaped target which generates X-rays in response to thermion bombardment; an anode disk having a central axis of rotation and a circumferential peripheral edge lying in a plane perpendicular to the axis of rotation, the target mounted to the disk adjacent the peripheral edge, the disk including means, formed integrally solid with the disk and remote from the target, for mounting the disk to the support shaft within the housing to permit rotation of the disk about the axis of rotation, the disk formed integrally solid along the aforementioned plane including that portion of the disk coincident with the axis of rotation, and the disk having a thickness which increases progressively radially inward at least in that portion of the disk between the target and the means for coupling; and means for bombarding the target with thermions to generate X-rays.

By making the central part of the anode disk continuously thicker than the peripheral part of the anode disk, and by manufacturing a coupling means, preferably in the form of a coupling shaft, integrally with the rotating anode disk, the resultant centrifugal stress may be equalized radially with the thickness of the disk upon high speed rotation of the disk. Accordingly, the anode disk of the high speed anode X-ray tube of the subject invention may be rotated at higher speeds than anodes of the prior art. As a consequence, a smaller focus of energy upon the target is permissible without having a corresponding increase in temperature at the surface of the target, due to the increased rotational speed of that target. Thus, a clearer and higher quality X-ray picture may be obtained with the higher speed rotation of the anode disk of the subject invention than was heretofore possible given prior art anode designs. In addition, due to the higher speed, the target may be made thinner than in prior art designs, thereby decreasing the negative effects of different coefficients of expansion and consequently reducing the likelihood that the target will be separated from the anode.

DETAILED DESCRIPTION OF THE PREFERRED EMBODIMENT

Figure 2:
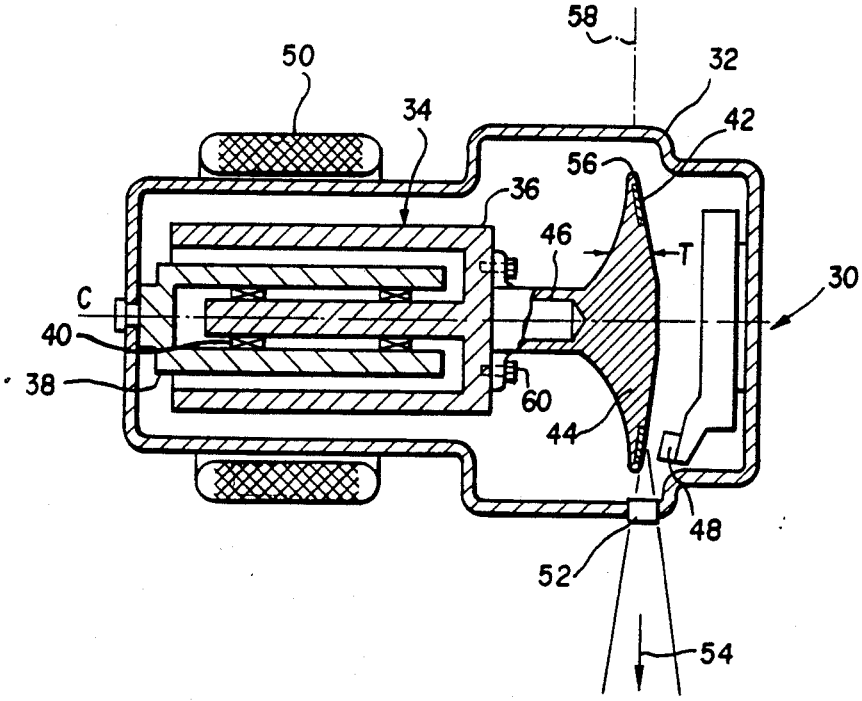
FIG. 2 is a sectional view of a rotating anode X-ray tube incorporating the teachings of the subject invention.

In FIG. 2 there is illustrated a rotating anode x-ray tube 30 comprising a vacuum housing 32; an anode support shaft 34 comprising a rotor 36, a stator 38 and bearings 40; a ring-shaped target 42; an anode disk 44; an anode coupling shaft 46; a cathode 48; stator windings 50; and an X-ray exit window 52.

Anode support shaft 34 is located at least in part within vacuum housing 32 and, as illustrated in FIG. 2, preferably comprises a stator 38 fixedly mounted to housing 32, a plurality of support bearings 40, and a rotor 36 supported on stator 38 by bearings 40. External stator windings 50 operate upon energization to permit rotor 36 to rotate about stator 38 to form a motor. The axis of rotation of rotor 36 is coincident with the central axis of stator 38. Bearings 40 may comprise mechanical or magnetic bearings as is well known to those skilled in the art. As is also well known to those skilled in the art, different variations of anode support shaft 34 may be obtained by utilization of a different form of motor. Support shaft 34 sufficies for purposes of the present invention provided shaft 34 provides rotatable support for anode disk 44 along axis of rotation C.

Cathode 48 preferably comprises a filament (not shown in FIG. 2) for emitting thermions as is well known to those skilled in the art. Ring-shaped target 42 is fitted to the surface of anode disk 44 opposite cathode 48 and ring-shaped target 42 is preferably made thinner than comparable ring-shaped targets known to the prior art. Ring-shaped target 42 may, for example, comprise tungsten, either in essential pure form or as an alloy. Accordingly, when thermions are radiated from a filament of cathode 48 upon heating of that filament, those thermions bombard target 42 causing X-rays to be generated from target 42, through window 52 of housing 32 in the direction of arrow 54.

Figure 1:
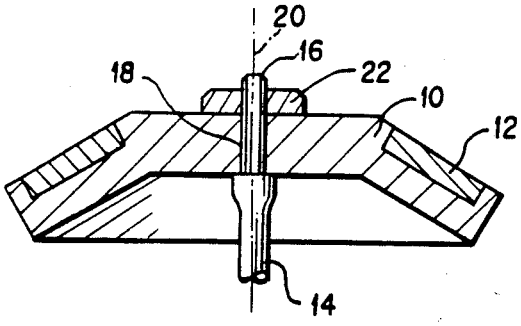
FIG. 1 PRIOR ART
FIG. 1 is a sectional view of a conventional rotating anode X-ray tube.

Anode disk 44 is preferably made of molybdenum, either in essentially pure form or as an alloy. Anode disk 44 has a central axis of rotation C and a circumferential peripheral edge 56 which lies in a plane 58 perpendicular to axis of rotation C. Target 42 is mounted on disk 44 adjacent peripheral edge 56. Disk 44 includes coupling shaft 46 formed integrally solid with disk 44 and remote from target 42. Coupling shaft 46 is structured to permit mounting of disk 44 to support shaft 36 within housing 32 to permit rotation of disk 44 about axis of rotation C. By being formed integrally solid with disk 44, shaft 46 avoids the disadvantage inherent in the prior art use of a support shaft and bore as shown in FIG. 1.

In accordance with the teachings of the present invention, disk 44 is formed integrally solid along plane 58, including that portion of disk 44 coincident with axis of rotation C. In addition, disk 44 has a thickness T which increases progressively radially inward at least in that portion of disk 44 between target 42 and coupling shaft 46 to counteract and preferably essentially equalize a corresponding increase of stress radially inward within disk 44 upon high speed rotation of disk 44. Preferably, thickness T increases progressively radially inward from peripheral edge 56 to coupling shaft 46. Typically, stress increases radially as an exponential inverse function of the radial distance from the axis of rotation of the disk. Thus, the thickness T of disk 44 preferably increases at least exponentially in a radially inward direction toward the axis of rotation C.

Disk 44, including coupling shaft 46, is preferably made of molybdenum or an alloy of molybdenum.

Coupling shaft 46 of disk 44 is fixed to rotor 36 of anode support shaft 34 along axis of rotation C by operation of a plurality of bolts 60 or the like to permit, upon activation of windings 50, rotation of anode disk 44 about axis of rotation C.

As is mentioned before, cathode 48 operates to bombard target 42 with thermions to generate X-rays from target 42 which exit housing 32 through window 52 in the direction of arrow 54.

Figure 3:
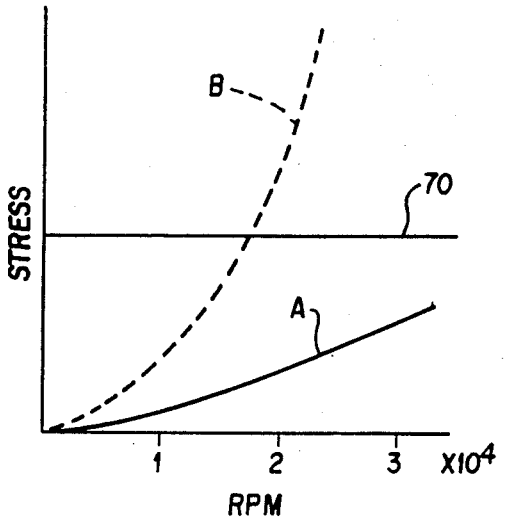
FIG. 3 is a graph of the relationship between the centrifugal stress in the central part of the anode of the subject invention in comparison with the centrifugal stress in the anode of the prior art FIG. 1.

The progressively increasing thickness T of anode disk 44 permits centrifugal stress to be almost equalized radially with that thickness within disk 44. This equalization of centrifugal stress with thickness, inter alia, reduces stress on that portion of disk 44 coincident with axis of rotation C in comparison to the amount of stress at the inside of prior art anodes of the type illustrated in FIG. 1. Specifically, as illustrated in FIG. 3, when disk 44 of FIG. 2 is rotated at 30,000 revolutions per minute (RPM) or more, a centrifugal stress A is obtained along the axis of rotation C which is less than the allowable stress indicated by horizontal line 70. Accordingly, the X-ray tube of the subject invention as illustrated in FIG. 2 is capable at being rotated at 30,000 RPM or more. However, in a conventional rotating anode X-ray tube of the type illustrated in FIG. 1, centrifugal stress which acts at the inside of prior art anodes is indicated in FIG. 3 generally by graph B. In such a conventional X-ray tube, wherein the anode is connected to a coupling shaft with a nut, the centrifugal stress at the inside of prior art anodes typically exceeds allowable stress when rotated at rates on the order of between 10,000 and 20,000 RPM.

Thus, the rotating anode X-ray tube of the subject invention can be rotated at a higher speed than conventional anodes, thereby effectively increasing the area of target 42 upon which thermions strike and, therefore, permitting target 42 to be heated more evenly with focused thermions. Since the resultant heat is displaced over a larger area due to the increased rate of rotation of target 42, the focus can be made smaller than in the prior art and, therefore, the resultant X-ray tube is capable of obtaining clearer and better quality X-ray pictures. Moreover, with anode disk 44 formed integrally with coupling shaft 46, imbalance of the resultant integral disk is minimized.

The thermal conductivity of tungsten or an alloy of tungsten is known to be lower than the thermal conductivity of molybdenum or an alloy of molybdenum. However, target ring 42 can be made thin due to the rapid rotation of disk 44 and the resultant diffusion of thermion bombardment on the surface of target 42. Thus, heat generated by bombardment of thermions on target 42 may be easily conducted to disk 44 which is made of molybdenum or an alloy of molybdenum. Moreover, since target 42 is thinner than in the prior art, target 42 has less likelihood of separating from the surface of disk 44 upon high speed rotation of disk 44.

Since the central portion of disk 44 is made thick and disk 44 is formed integrally with coupling shaft 46, the surface area of disk 44 is larger than that of the prior art embodiment as shown in FIG. 1. Making the surface of disk 44 large increases the radiation of heat emitted from disk 44 and thereby provides a favorable cooling effect.

As may be seen in FIG. 2, the thickness of the central portion of disk 44 is preferably made approximately three times as thick as the thickness of the peripheral portion of disk 44 at which target 42 is mounted. In addition, the thickness T of disk 44 is preferably increased as an exponential function from the peripheral edge 56 to the central portion of disk 44 adjacent axis of rotation C. With this exponential progressive increase in thickness T, disk 44 is capable of sustaining the centrifugal stress at high speeds of rotation, since that stress is uniformly distributed over the radial dimensions of disk 44. Accordingly, disk 44 is capable of high speed rotation.

As should be apparent to one skilled in the art, it is preferable that the area of disk 44 at which target 42 is mounted defines a flat surface so that target 42 may be mounted flat upon that surface.

Figure 4:
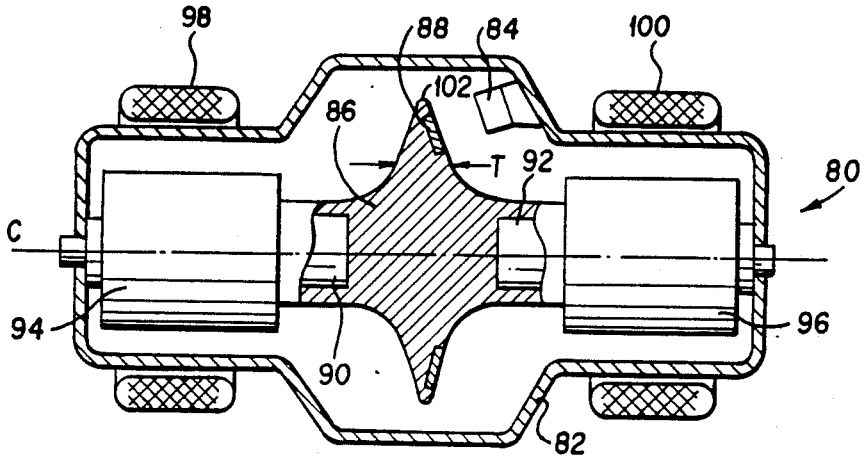
FIG. 4 is a sectional view of an alternative embodiment of a rotating anode X-ray tube incorporating the teachings of the subject invention.

An alternative embodiment of the present invention is illustrated in FIG. 4. Specifically, a rotating anode X-ray tube 80 is illustrated in FIG. 4 which comprises a vacuum housing 82; a cathode 84; an anode disk 86 having mounted thereon a ring-shaped target 88 and including first and second anode coupling shafts 90 and 92; first and second anode support shafts 94 and 96; and first and second stator windings 98 and 100.

As in the embodiment of FIG. 2, anode coupling shafts 90 and 92 are formed integrally with anode disk 86, and anode disk 86 is formed integrally solid along its entire radial direction including that portion of disk 86 coincident with axis of rotation C. The thickness T of anode disk 86 increases progressively in a radially inward direction from circumferential peripheral edge 102, including that portion of disk 86 between ring target 88 and coupling shafts 90 and 92, to equalize stress radially within disk 86 from the circumferential peripheral edge 102 to axis of rotation C upon high speed rotation of disk 86.

First and second anode support shafts 94 and 96 may be constructed identical to anode support shaft 34 of FIG. 2. In addition, first and second windings 98 and 100, in combination with support shafts 94 and 96, provide respective motors for rotating support shafts 94 and 96, respectively. Coupling shafts 90 and 92 are structured to mount disk 86 between support shafts 94 and 96, with one side of disk 86 affixed to support shaft 94 and the other side of disk 86 affixed to support shaft 96 through operation of coupling shafts 90 and 94, respectively.

Thus, disk 86 is formed in a shape with bilateral symmetry, with the thickness of disk 86 continuously increasing in a radially inward direction from peripheral edge 102 toward the axis of rotation C, preferably in an exponential manner.

In the rotating anode X-ray tube of FIG. 4, the central portion of anode disk 86 along axis of rotation C can be made thicker than the comparable central portion of anode disk 44 in FIG. 2. Accordingly, the central portion of anode disk 86 is strengthened against centrifugal stress and the resultant body of revolution, including anode disk 86, can be rotated at a high speed. Moreover, a static and dynamic (ex. rotative) load of anode disk 86 can be divided equally between anode support shaft 94 and anode support shaft 96.

Additional advantages and modifications will readily occur to those skilled in the art. The invention in its broader aspects is, therefore, not limited to the specific details, representative apparatus and illustrative examples shown and described. Accordingly, departures may be made from such details without departing from the spirit or scope of applicants' general inventive concept.

We claim:

1. A rotating anode x-ray tube comprising:

a vacuum housing;

an anode support shaft located at least in part inside said housing;

means for rotating said support shaft;

a ring-shaped target which generates x-rays in response to thermion bombardment;

an anode disk having a central axis of rotation and a circumferential peripheral edge lying in a plane perpendicular to said axis of rotation, said target mounted to said disk adjacent said peripheral edge, said disk including means, formed as a solid unitary structure with said disk and remote from said peripheral edge, for mounting said disk to said support shaft within said housing to permit rotation of said disk about said axis of rotation, said means for mounting located inside and remote from said ring-shaped target to leave a portion of said disk between said target and said means for mounting, said disk formed as a solid unitary structure along said plane, including that portion of said disk coincident with said axis of rotation, and said disk having a thickness which increases exponentially radially inward from said peripheral edge of said disk to said means for mounting at a rate sufficient to equalize stress radially within said disk upon rotation of said support shaft; and means for bombarding said target with thermions to generate said x-rays.

2. A rotating anode x-ray tube according to claim 1 wherein said disk has a thickness which increases progressively radially inward from said peripheral edge.

3. A rotating anode X-ray tube according to claim 1 wherein said anode disk comprises molybdenum and said target comprises a thin layer of tungsten.

4. A rotating anode X-ray tube according to claim 1 wherein said means for mounting said disk comprises a coupling shaft formed solid with said disk, with the axis of said coupling shaft aligned coincident with said axis of rotation of said disk.

5. A rotating anode X-ray tube according to claim 1 including first and second anode support shafts and wherein said means for mounting said disk is structured to mount said disk between said support shafts with one side of said disk affixed to said first support shaft and the other side of said disk affixed to second support shaft, and wherein said means for rotating comprises first and second motors to rotate said first and second support shafts, respectively.

* * * * *